US010139086B2

(12) United States Patent
Shimizu

(10) Patent No.: US 10,139,086 B2
(45) Date of Patent: Nov. 27, 2018

(54) LIGHT FIXTURE HAVING RETRACTABLE FRONT PANEL SURFACE

(71) Applicant: PANASONIC INTELLECTUAL PROPERTY MANAGEMENT CO., LTD., Osaka (JP)

(72) Inventor: Takayuki Shimizu, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/922,379

(22) Filed: Mar. 15, 2018

(65) Prior Publication Data

US 2018/0266664 A1 Sep. 20, 2018

(30) Foreign Application Priority Data

Mar. 16, 2017 (JP) ..... 2017-051611

(51) Int. Cl.

| | |
|---|---|
| ***F21S 8/04*** | (2006.01) |
| ***F21V 21/02*** | (2006.01) |
| ***F21V 17/16*** | (2006.01) |
| ***F21S 10/00*** | (2006.01) |
| ***F21S 8/02*** | (2006.01) |
| ***F21V 21/04*** | (2006.01) |
| *F21S 4/20* | (2016.01) |

(52) U.S. Cl.

CPC ..... *F21V 17/162* (2013.01); *F21S 8/026* (2013.01); *F21S 8/028* (2013.01); *F21S 10/005* (2013.01); *F21V 21/04* (2013.01); *F21S 4/20* (2016.01)

(58) Field of Classification Search

CPC ..... F21S 8/026; F21S 8/028; F21S 10/005; F21V 17/162; F21V 21/04

See application file for complete search history.

(56) References Cited

U.S. PATENT DOCUMENTS 6,588,922 B1 * 7/2003 DeCicco ..... F21V 21/04 362/148
9,121,573 B2 * 9/2015 Johns ..... F21S 8/063

FOREIGN PATENT DOCUMENTS

JP 7-161212 6/1995

* cited by examiner

*Primary Examiner* — Karabi Guharay
(74) *Attorney, Agent, or Firm* — Greenblum & Bernstein, P.L.C.

(57) ABSTRACT

A light fixture which is configured to be embedded in a surface is provided. The light fixture includes a light source and a front panel located in front of the light source. A frame is in contact with a front panel surface of the front panel. A pressure mechanism is configured to press the front panel surface against the frame. A fixing piece is provided at a position opposite to the front panel. The fixing piece extends outward from the base surface side to fix the frame to an external structure. The pressure mechanism is retractable by a distance greater than a thickness of the front panel when a pushing force is applied to the front panel surface. The front panel is movable in a direction perpendicular to a retractable direction of the pressure mechanism when the pressure mechanism is retracted.

6 Claims, 6 Drawing Sheets

LIGHT FIXTURE HAVING RETRACTABLE FRONT PANEL SURFACE

BACKGROUND OF THE INVENTION

Technical Field

The present disclosure relates to an embedded light fixture.

Background Art

Embedded light fixtures are known that are embedded in walls or ceilings of building structures and the like. Japanese Patent Application Publication No. H07-161212 discloses an embedded light fixture which is embedded in a ceiling and includes a light-penetrating front cover and a front frame supporting the front cover.

The front frame includes hinges and fixing pieces for supporting the front cover and therefore projects from the ceiling surface toward a light emitting region. The front frame projects to the outside of an embedding hole in which a body portion of the light fixture is embedded, since the front frame is supported by screws or the like for fixing the entire light fixture to the ceiling from the light emitting region side.

Since the front frame has a complex shape projecting from the body portion of the light fixture housed in the embedding hole, a frame surface of the front frame cannot easily be aligned along the ceiling surface. When the light fixture having the entire configuration described above is installed such that the frame surface of the front frame is aligned along the ceiling surface, the ceiling surface needs to be preliminarily provided with a counterbore portion conforming to the shape of the front frame, for example.

Further, when an operator does maintenance of the body portion while keeping the light fixture attached to the ceiling, the operator should release the fixed state of the front cover fixed with the fixing pieces to remove the front cover toward the light emitting region. Namely, the operator should detach and move the front cover to another place or dodge the front cover hanging on the ceiling to do the maintenance, which reduces the efficiency of the operations.

SUMMARY OF THE INVENTION

The present disclosure has been made in view of the above problems. An object of the present disclosure is to provide a light fixture having a configuration which facilitates alignment along a structure surface at an installation position and contributes to an improvement in operating efficiency during maintenance.

One aspect of the present disclosure is a light fixture configured to be embedded in a surface, the light fixture including: a light source; a front panel located in front of the light source; a frame in contact with a front panel surface of the front panel; a pressure mechanism configured to press the front panel surface against the frame; and a fixing piece provided at a position opposite to the front panel on a base surface side opposite to a front surface side on which the front panel surface is exposed, the fixing piece extending outward from the base surface side to fix the frame to an external structure, wherein the pressure mechanism is retractable by a distance greater than a thickness of the front panel when a pushing force is applied to the front panel surface, and the front panel is movable in a direction perpendicular to a retractable direction of the pressure mechanism when the pressure mechanism is retracted.

BRIEF DESCRIPTION OF DRAWINGS

The figures depict one or more implementations in accordance with the present teaching, by way of example only, not by way of limitations. In the figures, like reference numerals refer to the same or similar elements.

DETAILED DESCRIPTION

Embodiments of the present disclosure will be described below with reference to the drawings. In the following description, a direction perpendicular to a front panel surface of a front panel included in a light fixture and in which a light source in the light fixture faces is defined as a Z direction, and the other directions perpendicular to the Z direction are respectively defined as X and Y directions. The direction in which the front panel is moved during maintenance corresponds to the X direction.

First Embodiment

Figure 1:
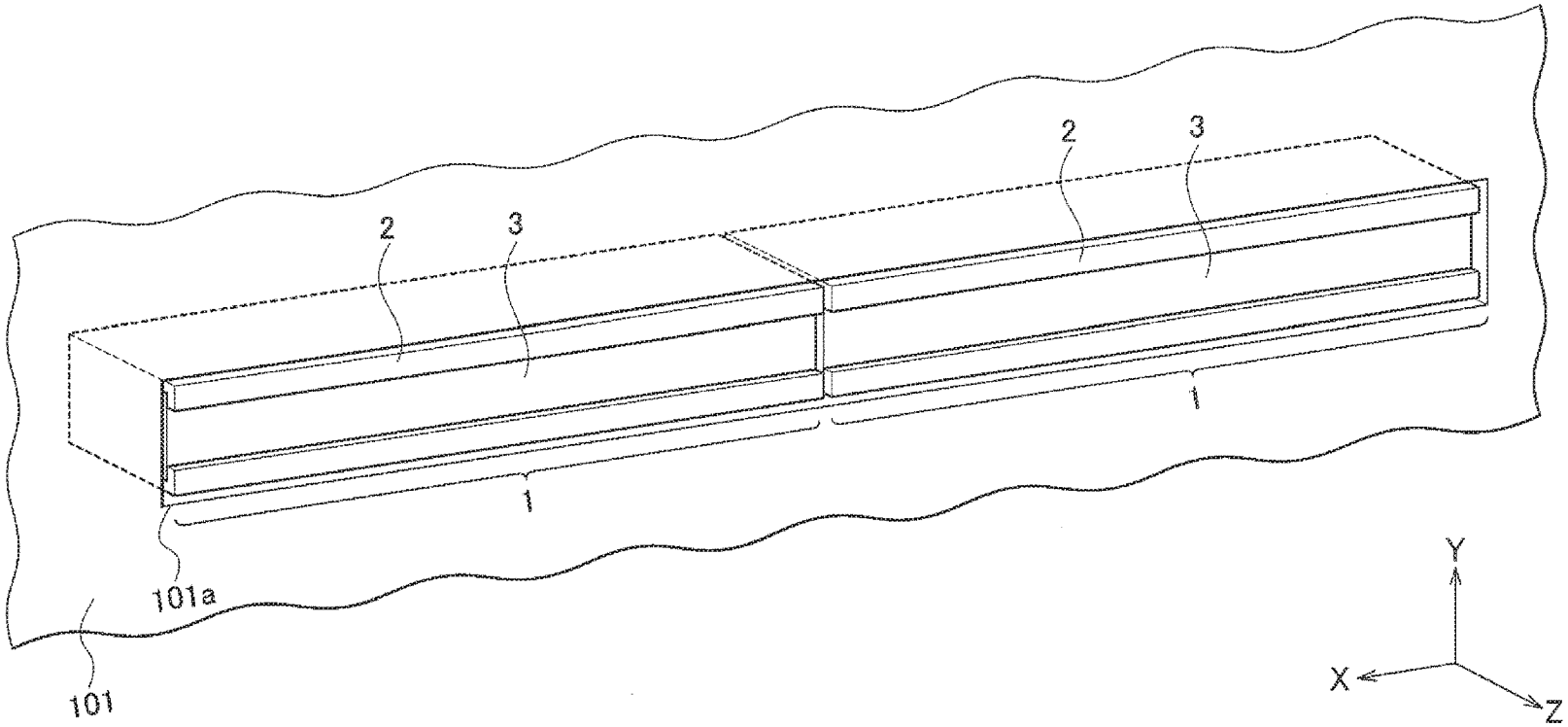
FIG. 1 is a perspective view of a light fixture according to an embodiment of the present disclosure.

A configuration of a light fixture according to a first embodiment is described below. FIG. 1 is a perspective view illustrating the entire light fixture 1 according to the present embodiment. The light fixture 1 includes a frame 2 defining a body portion, and a front panel 3 through which emission light of the light fixture is transmitted. The light fixture 1 is an embedded light fixture in which a front panel surface 3*a* of the front panel 3 (refer to FIG. 2) is exposed to the outside while the entire frame 2 is embedded in a wall 101 of a building structure or the like. The front panel surface 3*a* is one of main planes of the front panel 3 through which the emission light is emitted from the light fixture 1 toward a light emitting region which is the outside of the light fixture 1. The entire shape of the light fixture 1 is a substantially rectangular parallelepiped elongated in the X direction. The light fixture 1 according to the present embodiment includes a single front panel 3. The front panel 3 in which the front panel surface 3*a* is defined as an X-Y plane is elongated to conform to a length of the frame 2 in a direction in which the frame 2 is elongated.

The wall 101 has a wall opening 101*a* through which the light fixture 1 is housed. The wall opening 101*a* has dimensions conforming to the outline of the light fixture 1 on the front side on which the front panel surface 3*a* of the front panel 3 is exposed. FIG. 1 illustrates a case in which a width of the wall opening 101*a* in the Y direction conforms to a width of the light fixture 1 in the Y direction, and a length of the wall opening 101*a* in the X direction forms to the total length of the two light fixtures 1 aligned in the X direction. As used herein, the phrase "conforming to the dimensions of the two light fixtures 1 in the respective directions" encompasses a state in which the two light fixtures 1 can be inserted to the call opening 101*a* from a wall surface 101*b* of the wall 101 (refer to FIG. 2), and a state in which there is a hardly-recognizable gap between the light fixtures 1 and the wall opening 101*a* in appearance.

Figure 2:
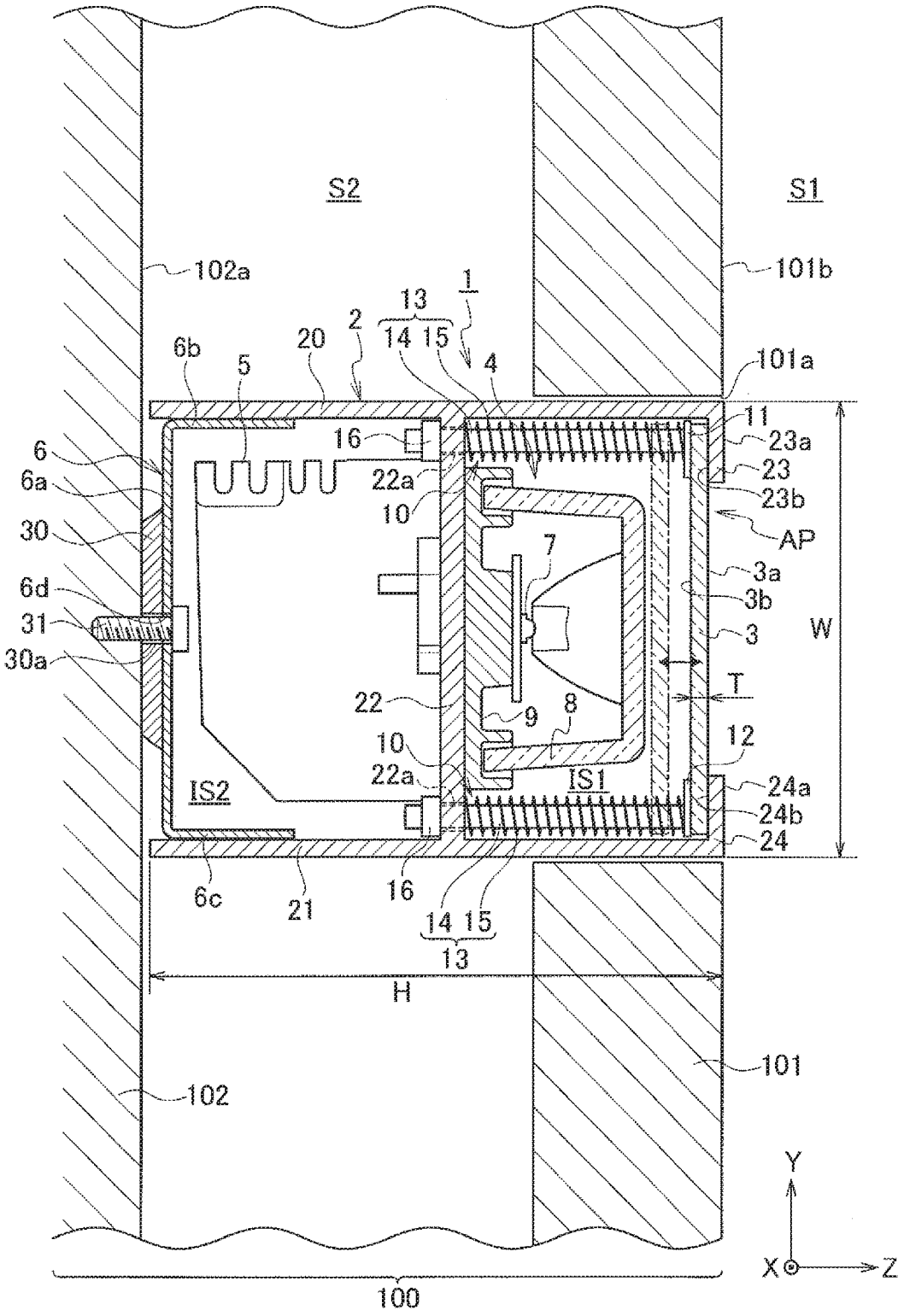
FIG. 2 is a cross-sectional view of the light fixture according to the embodiment of the present disclosure.

FIG. 2 is a cross-sectional view showing an installation position and a structure of the respective light fixtures 1. A wall portion 100 is an example of the installation position of the light fixtures 1. A first space S1 is the light emitting region irradiated with the emission light emitted from the light fixtures 1. The wall portion 100 includes the wall 101 facing the first space S1, and a vertical wall 102 parallel to the wall 101 with a second space S2 interposed therebetween, for example. The second space S2 is an internal space in which electric wires and the like connected to the light fixtures 1 are installed. The second space S2 is not visually recognized from the first space S1 in the state in which the light fixtures 1 are installed in the wall portion 100.

The frame 2 is defined by five plates including a first plate 20, a second plate 21, a third plate 22, a fourth plate 23, and a fifth plate 24. The first plate 20 and the second plate 21 each have an X-Z plane as a main plane defined by the short sides in the Z direction in which the emission light is emitted and the long sides in the X direction in which the frame 2 is elongated. The first plate 20 and the second plate 21 are separated and opposed to each other in the Y direction.

The third plate 22 has an X-Y plane as a main plane. The third plate 22 is located between the first plate 20 and the second plate 21. The upper end of the third plate 22 in the Y direction is connected to the main plane of the first plate 20, and the lower end of the third plate 22 in the Y direction is connected to the main plane of the second plate 21. The third plate 22 is connected to substantially the middle of the main plane of each of the first plate 20 and the second plate 21 in the Z direction. The inside of the frame 2 is thus divided by the third plate 21 into a first internal space IS1 in which the front panel 3 is located and a second internal space IS2 on the other side of the first internal space IS1.

The fourth plate 23 and the fifth plate 24 each have an X-Y plane as a main plane. The upper end of the fourth plate 23 in the Y direction is connected to the front end of the first plate 20 in the Z direction, and the lower end of the fourth plate 23 in the Y direction projects toward the second plate 21. The lower end of the fifth plate 24 in the Y direction is connected to the front end of the second plate 21 in the Z direction, and the upper end of the fifth plate 24 in the Y direction projects toward the first plate 20. The fourth plate 23 and the fifth plate 24 are separated from each other in the Y direction, while the fourth plate 23 and the fifth plate 24 project to be opposed to each other. The region between the fourth plate 23 and the fifth plate 24 separated from each other serves as an aperture AP through which the emission light is emitted.

The frame 2 may be made of an aluminum alloy and manufactured by extrusion molding. The material or the manufacture method for the frame 2 is not intended to be limited to that described above.

The front panel 3 is a long plate member elongated in the X direction and having a width in the Y direction. The material used for the front panel 3 may be a light-penetrating material such as resin or glass. The front panel 3 is particularly preferably a diffusion panel capable of efficiently diffusing the emission light to the outside.

The light fixture 1 includes a luminaire body 4 and a power source unit 5. The luminaire body 4 is located in the first internal space IS1. The luminaire body 4 includes a light source 7 such as an LED light source, a cover 8, and a socket 9 to which the light source 7 and the cover 8 are connected. The type of the light source 7 and the number of the light sources 7 included in the single light fixture 1 may be determined as appropriate. The cover 8 is made of a light-penetrating material such as resin or glass. The cover 8 covers and protects the light source 7. The cover 8 may be fixed to the frame 2 via another element other than the socket 9. The socket 9 is attached to the third plate 22 of the frame 2. The socket 9 is electrically connected to the power source unit 5 so as to supply electricity to the light source 7. The light source 7, the cover 8, and the socket 9 each have a size allowing the operator to install or remove the light source 7, the cover 8, and the socket 9 through the aperture AP. A method of attaching the light source 7 or the cover 8 to the socket 9 or a method of attaching the socket 9 to the third plate 22 of the frame 2 may be any method which allows the operator to attach the respective members through the aperture AP, regardless of the way such as fastening with screws or mutual engagement with engagement pieces provided in the respective members.

The power source unit 5 is located in the second internal space IS2. The power source unit 5 is attached to the third plate 22 of the frame 2, for example. In the case in which the light source 7 is an LED light source, the power source unit 5 covers alternating current to direct current to supply electricity to the socket 9. A terminal block or the like may be used instead of the power source unit 5.

The light fixture 1 includes a fixing piece 6 provided in the second internal space IS2. The fixing piece 6 is a member extending outward from the base surface side to fixing the frame 2 to an external structure. The fixing piece 6 is opposed to the front panel 3 on the base surface side of the light fixture 1 opposite to the front surface side on which the front panel surface 3*a* of the front panel 3 is exposed. As used herein, the expression "the fixing piece 6 is opposed to the front panel 3" refers to a state in which the fixing piece 6 is located behind the front panel surface 3*a* having a surface area sufficient to substantially entirely cover the fixing piece 6 in a projection view in the Z direction as viewed from the first space S1. The fixing piece 6 is formed by a bend of a metal plate, for example. The fixing piece 6 includes a first flat plate 6*a* parallel to the X-Y plane, a second flat plate 6*b* parallel to the X-Z plane and in contact with the main plane of the first plate 20, and a third flat plate 6*c* parallel to the X-Z plane and in contact with the main plane of the second plate 21, for example. The second flat plate 6*b* is connected to one end of the first flat plate 6*a*. The third flat plate 6*c* is connected to the other end of the first flat plate 6*a*. The first flat plate 6*a* is provided with a plurality of bolt holes 6*d* at regular intervals in the X direction located in the middle in the Y direction, for example. The fixing piece 6 is preliminarily fixed to the first plate 20 and the second plate 21 such that the first flat plate 6*a* is located in a region between the respective rear edges of the first plate 20 and the second plate 21 in the Z direction.

The light fixture 1 further includes a panel holding member 10 provided in the first internal space IS1. The panel holding member 10 is a mechanism for holding the front panel 3 to the frame 2. Both edges of the front panel surface 3*a* in the width direction are normally in contact with part of the frame 2 so that the front panel 3 is supported by the frame 2. In particular, one of end regions of the front panel surface 3*a* on the upper side in the Y direction is in contact with a surface 23*b* of the fourth plate 23 defining the frame 2 toward the first internal space IS1, and the other end region of the front panel surface 3*a* on the lower side in the Y direction is in contact with a surface 24*b* of the fifth plate 24 defining the frame 2 toward the first internal space IS1.

The panel holding member 10 includes first and second holding plates 11 and 12 opposed to each other in the Y direction, and pressure mechanisms 13 corresponding to the respective first and second holding plates 11 and 12. The first holding plate 11 is in contact with a part of a rear panel surface 3*b* of the front panel 3 opposite to the front panel surface 3*a* to press the front panel 3 against the fourth plate 23. The second holding plate 12 is in contact with a part of the rear panel surface 3*b* to press the front panel 3 against the fifth plate 24. The respective holding plates 11 and 12 may be a flat metal piece or a member made of a resin material. The length of the holding plates 11 and 12 in the X direction may conform to the length of the front panel 3 in the elongated direction. The panel holding member 10 may include more than one holding plate 11 and more than one holding plate 12. The holding plates 11 and 12 preferably do not excessively block the emission light emitted through the aperture AP. The holding plates 11 and 12 therefore each have a width in the Y direction sufficiently small to be hidden behind the fourth plate 23 and the fifth plate 24, respectively, as viewed from the first space S1.

The pressure mechanisms 13 press the front panel 3 against the fourth plate 23 and the fifth plate 24 of the frame 2 via the first holding plate 11 and the second holding plate 12, respectively. The pressure mechanisms 13 may be coil springs which are elastic bodies for causing pressure force. In this case, each of the pressure mechanisms 13 includes a support shaft 14 and a coil spring 15. One end of the support shaft 14 is fixed to the first holding plate 11 or the second holding plate 12, and the other end of the support shaft 14 is slidably fitted to an insertion hole 22*a* preliminarily provided in a part of the third plate 22 at a position opposed to the fourth plate 23 or the fifth plate 24 in the Z direction. The coil spring 15 is attached and wound on the support shaft 14. One end of the coil spring 15 is in contact with the first holding plate 11 or the second holding plate 12. The other end of the coil spring 15 is in contact with the surface of the third plate 22. The support shaft 14 at the other end on the third plate 22 side may be provided with a stopper 16 for regulating a movement range of the first holding plate 11 or the second holding plate 12 toward the fourth plate 23 or the fifth plate 24. The pressure mechanism 13 does not necessarily press the front panel 3 against the fourth plate 23 or the fifth plate 24 via the first holding plate 11 or the second holding plate 12, but may press the front panel 3 directly by the one end of the support shaft 14. However, it is preferable to use the pressure plates 11 and 12 each having a particular contact area sufficient to stably support the front panel 3 or prevent damage to the front panel 3.

The pressure force caused by the coil spring 15 should be sufficient to evenly and stably hold and support the front panel 3 between the first holding plate 11 and the fourth plate 23 or between the second holding plate 12 and the fifth plate 24. In addition, the strength of the pressure force caused by the coil spring 15 needs to allow the front panel 3 to be pushed toward the first internal space IS1 of the light fixture 1 when the operator pushes the front panel 3 inward from the first space S1. The pressure mechanism 13, particularly the coil spring 15, needs to be retracted by a distance greater than the thickness T of the front panel 3 when the pushing force is applied by the operator. FIG. 2 indicates the movement range of the front panel 3 by the double-headed arrow in the direction perpendicular to the front panel surface 3*a*. The depth of the first internal space IS1 in the Z direction is thus determined in view of the depth of the luminaire body 4 in the Z direction so that the front panel 3 is not brought into contact with the luminaire body 4 when the front panel 3 is moved within the movement range indicated by the double-headed arrow.

Figure 3:
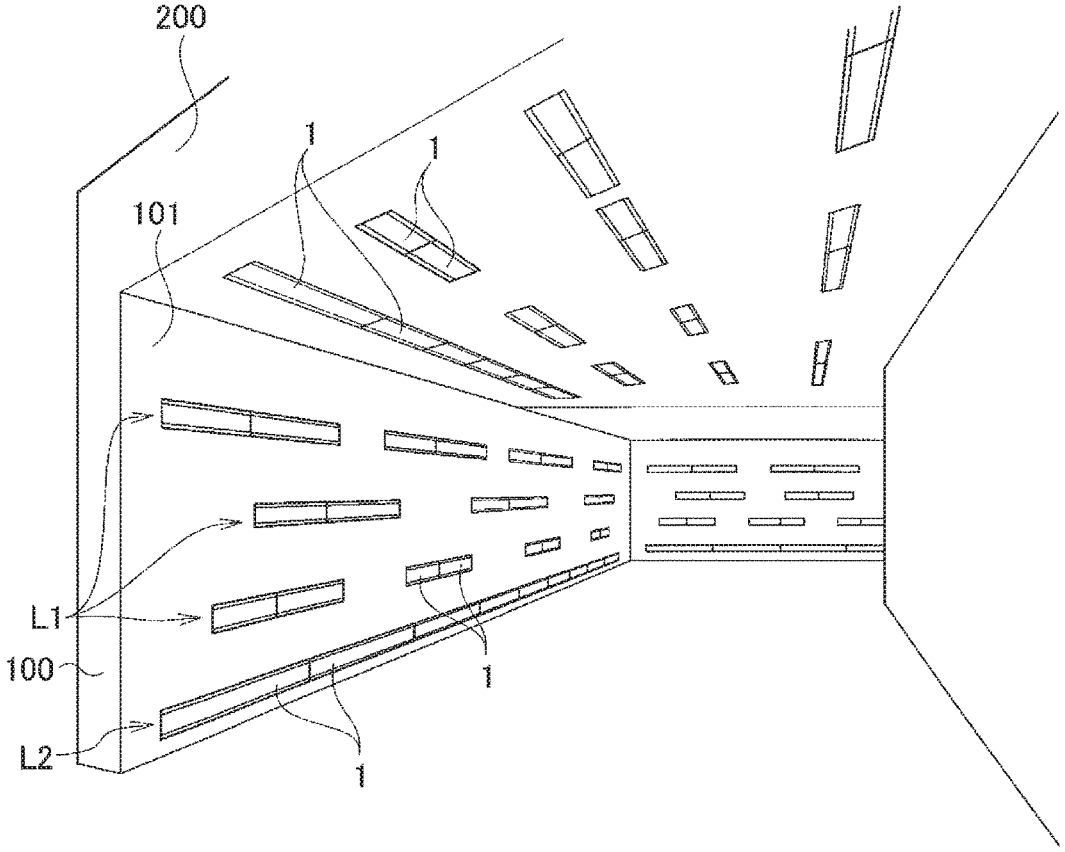
FIG. 3 is a view showing an installation example of the light fixture according to the embodiment of the present disclosure.

Next, an installation example of the light fixture 1 is described below. FIG. 3 is a view showing the installation example of the light fixture 1. FIG. 3 illustrates a case in which a plurality of light fixtures 1 is installed in a vehicle guide path inside a building. As illustrated in FIG. 2, the light fixture 1 may be installed in the wall portion 100. In this case, the following installation examples may be considered. A first installation example is indicated by layout L1 in which the two light fixtures 1 as illustrated in FIG. 1 are installed in pairs in the wall 101. Plural pairs of the light fixtures 1 may be aligned at intervals or arranged in rows at intervals. The dimensions of each light fixture 1 may be varied as appropriate. Accordingly, the entire lighting can be designed to have a streamline configuration, for example. A second installation example is indicated by layout L2 in which the number of the light fixtures 1 included in each set is not limited two, and more than two light fixtures 1 may be continuously aligned without interval. The light fixtures 1 may also be installed in a ceiling 200 of the vehicle guide path. The positions, dimensions, or combinations of the light fixtures 1 installed in the ceiling 200 may be determined as appropriate, as in the case of the installation in the wall portion 100.

Next, the process of installation of the light fixture 1 is described below. The installation position at which the light fixtures 1 are installed is illustrated herein with the wall portion 100 shown in FIG. 2. As described with reference to FIG. 1, the wall 101 is provided with the wall opening 101*a* for housing the light fixtures 1. When the light fixtures 1 are inserted into the second space S2 through the wall opening 101*a* from the first space S1 side, the first flat plate 6*a* of the fixing piece 6 is led to reach a wall surface 102*a* of the vertical wall 102. The outer surface of the first flat plate 6*a* is preferably preliminarily provided with a spacer 30. The spacer 30 is made of an elastic body such as rubber and formed into a plate shape having a particular thickness. The spacer 30 is provided in the middle with a penetration hole 30*a* with a central axis conforming to the bolt hole 6*b* provided in the first flat plate 6*a*. The operator then passes a bolt 31 through the bolt hole 6*d* of the first flat plate 6*a* and the penetration hole 30*a* of the spacer 30 from the first space S1 side, and fastens and fixes the bolt 31 to a hole preliminarily provided on the vertical wall 102. The third plate 22 is preferably provided with a plurality of penetration holes at positions corresponding to the respective bolts 31 so that the operator can insert a screwdriver as a tool toward the bolts 31 from the first space S1 side. Accordingly, the light fixtures 1 are easily installed in the wall portion 100 without direct contact with the wall 101.

Figure 4A:
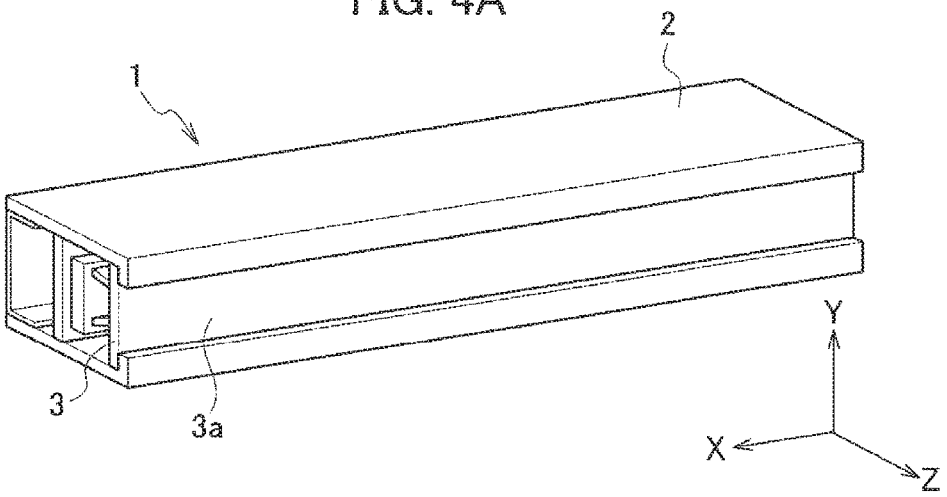
FIG. 4A is a perspective view illustrating a step of movement of a front panel according to the embodiment.
Figure 4B:
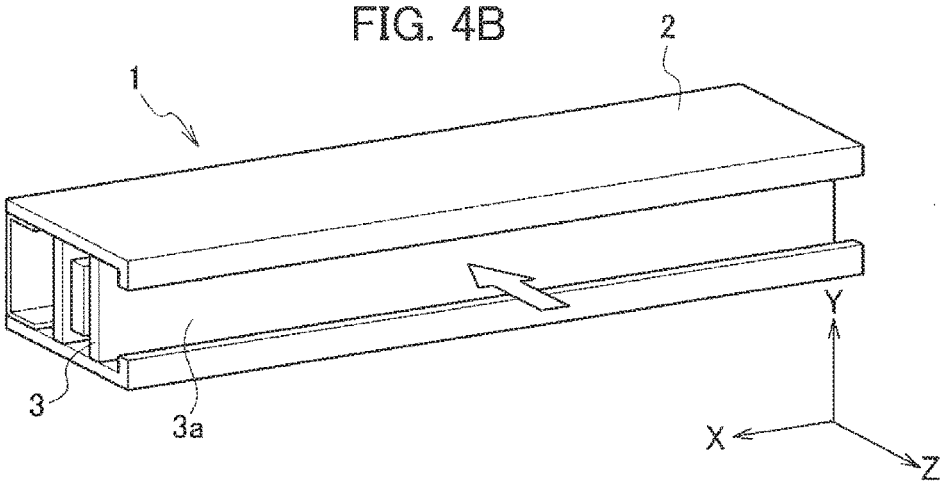
FIG. 4B is a perspective view illustrating a step of movement of the front panel according to the embodiment.
Figure 4C:
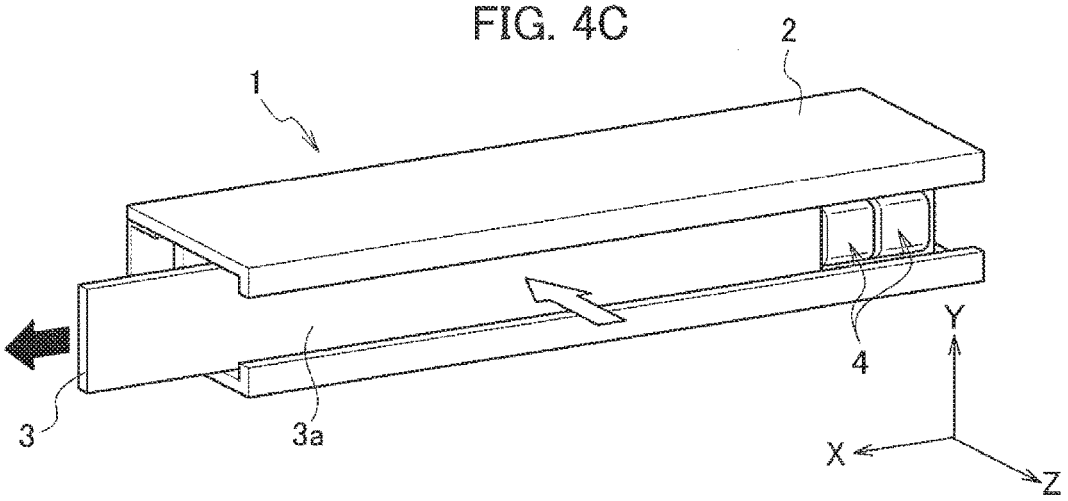
FIG. 4C is a perspective view illustrating a step of movement of the front panel according to the embodiment.

Next, the process of movement of the front panel 3 is described below. FIG. 4A to FIG. 4C are perspective views illustrating a series of steps of movement of the front panel 3. In particular, FIG. 4A is a view showing a state before the front panel 3 is moved. FIG. 4B is a view showing a state in which the front panel 3 is moved toward the inside of the light fixture 1. FIG. 4C is a view showing a state in which the front panel 3 is moved toward a side surface of the light fixture 1. As used herein, the term "side surface" refers to an open face open in the same direction as the cross-sectional view shown in FIG. 2 when the front plate 3 is defined as a front surface.

The operator can push the front panel 3 in the state shown in FIG. 4A toward the inside of the light fixture 1 from the first space S1 side, as indicated by the white arrow shown in FIG. 4B. In the state shown in FIG. 4B, the front panel surface 3*a* of the front panel 3 is not in contact with any surface. The rear panel surface 3*b* of the front panel 3 is not fixed to the holding plate 11 or 12 but merely pushed against the holding plates 11 and 12 by the operator. The side surfaces on both sides of the light fixture 1 are open without being blocked by any plate member, as shown in FIG. 4A to FIG. 4C. Therefore, the front panel 3 can be slid along the holding plates 11 and 12 and freely moved toward either side surface of the light fixture 1, namely, in the direction perpendicular to a retractable direction of the pressure mechanisms 13, as indicated by the black arrow shown in FIG. 4C.

Next, the effects of the light fixture 1 are described below. The light fixture 1 which is configured to be embedded in a surface, includes the light source 7, the front panel 3, the frame 2 (23, 24), the pressure mechanisms 13, and the fixing piece 6. The front panel 3 is located to face the light source 7. The frame 2 is in contact with the front panel surface 3*a* of the front panel 3. The pressure mechanisms 13 press the front panel surface 3*a* against the frame 2. The pressure mechanisms 13 can be retracted by a distance greater than the thickness T of the front panel 3 when the pushing force is applied to the front panel surface 3*a*. The front panel 3 can be moved in the direction perpendicular to the retractable direction of the pressure mechanisms 13 when the pressure mechanisms 13 are retracted. The fixing piece 6 extends outward from the base surface side to fix the frame 2 to an external structure. The fixing piece 6 is opposed to the front panel 3 on the base surface side of the light fixture 1 opposite to the front surface side on which the front panel surface 3*a* of the front panel 3 is exposed to the outside.

First, with regard to the installation of the light fixture 1, the front panel 3 is pressed against the fourth plate 23 and the fifth plate 24 so as to be supported to the frame 2. The main planes of the fourth plate 23 and the fifth plate 24 are parallel to the front panel surface 3*a* of the front panel 3. The front panel surface 3*a* is in appearance parallel to the wall surface 101*b* of the wall 101 facing the first space S1. Namely, a surface 23*a* of the fourth plate 23 facing the first space S1 and a surface 24*a* of the fifth plate 24 facing the first space S1, which are frame surfaces of the light fixture 1, are also parallel to the wall surface 101*b*. Thus, as illustrated in FIG. 2, a distance between the wall surface 101*b* of the wall 101 and the wall surface 102*a* of the vertical wall 102 is preliminarily determined to conform to the size of the first plate 20 or the second plate 21 in the Z direction, namely, conform to the height H of the light fixture 1. Accordingly, the surface 23*a* of the fourth plate 23 and the surface 24*a* of the fifth plate 24 can be aligned along the wall surface 101*b* when the light fixture 1 is installed in the wall portion 100.

In the light fixture 1, a distance in the frame 2 between the outer surface of the main plane of the first plate 20 and the outer surface of the main plane of the second plate 21, namely, the width W of the light fixture 1 in the Y direction is constant. In other words, either the fourth plate 23 or the fifth plate 24 supporting the front panel 3 does not project outward from the outer surface of the main plane of the first plate 20 or the outer surface of the main plane of the second plate 21. This configuration can simplify the shape and reduce the size of the entire light fixture 1. Further, since the width W of the light fixture 1 is constant, the wall opening 101*a* through which the light fixture 1 is inserted can be simplified and easily formed because the size of the wall opening 101*a* may be determined depending on the dimensions of the light fixture 1.

The frame 2 of the light fixture 1 is fixed to an external structure via the fixing piece 6 opposite to the front panel 3 on the base surface side of the light fixture 1 opposite to the front surface side on which the front panel surface 3*a* of the front panel 3 is exposed. Since the light fixture 1 is not in direct contact with the wall 101 facing the first space S1 which is the light emitting region, the shape of the wall opening 101*a* provided on the wall 101 is not complicated, in contrast to the conventional light fixture in which a shape of a wall opening is inevitably complicated so as to conform to the light fixture having a complex configuration. Accordingly, the surface 23*a* of the fourth plate 23 and the surface 24*a* of the fifth plate 24 can be aligned along the wall surface 101*b* more easily. Since the respective surfaces can be aligned, the wall surface 101*b* housing the light fixtures 1 is flattened, which improves the entire appearance. In addition, the flattened wall surface 101*b* can avoid the danger of causing injury to pedestrians walking close to the light fixtures 1 because of accidental contact, or reduce the risk of causing damage to vehicle bodies in the event of a minor collision with the wall surface 101*b*.

Further, when the light fixture 1 is installed in the wall portion 100 such that the bolts 31 are fastened to the vertical wall 102 via the spacers 30, the thickness of each spacer 30 which is an elastic body varies depending on the fastening force applied to each bolt 31. Therefore, the operator can make fine adjustments to a gap between the wall surface 101*b* and each of the surface 23*a* of the fourth plate 23 and the surface 24*a* of the fifth plate 24 by adjusting the fastening force applied to the respective bolts 31, which facilitates the alignment of the respective surfaces. In addition, the use of the spacers 30 of the elastic bodies is preferable in order to absorb oscillations transmitted from the vertical wall 102 to reduce the oscillations transmitted to the light fixture 1.

Second, with regard to the movement of the front panel 3, the operator on the first space S1 side can easily move the front panel 3 toward the side surface of the light fixture 1. In particular, a set of at least two light fixtures 1, as illustrated in FIG. 1, is installed in the wall portion 100 in a state in which the side surfaces of the respective light fixtures 1 which are open are in contact with each other. The operator pushes the front panel 3 of the first light fixture 1, located on the left side in FIG. 1 as viewed from the first space S1, inward as illustrated in FIG. 4B. Since the front panel 3 is pushed by a distance greater than the thickness T of the front panel 3, a space sufficient to house another front panel 3 is provided in front of the front panel surface 3*a* of the first light fixture 1. The operator then moves the front panel 3 of the second light fixture 1, located on the right side as viewed from the first space S1, toward the adjacent first light fixture 1 as illustrated in FIG. 4C, while keeping the pushed state of the front panel 3 of the first light fixture 1. The front panel 3 of the second light fixture 1 is thus inserted into the space provided in front of the pushed front panel 3 of the first light fixture 1. In addition, the first internal space SI1 of the second light fixture 1 is exposed due to the movement of the front panel 3 toward the first light fixture 1, so that the operator can touch the luminaire body 4 and the like from the first space S1 side. Alternatively, the front panel 3 of the first light fixture 1 may be moved toward the second light fixture 1 in the manner reverse to the process described above.

Thus, the installation of at least two light fixtures 1 aligned next to each other in the wall portion 100 can allow the operator to easily replace the luminaire body 4 and the like from the first space S1 side during maintenance, for example. The operator can do maintenance without the step of removing the light fixture 1 entirely from the wall portion 100 or the step of detaching the front panel 3 from the frame 2.

As described above, the present embodiment can provide the light fixture having the advantage of easy alignment with the surface of the structure at the installation position and operating efficiency during maintenance.

Second Embodiment

Figure 5A:
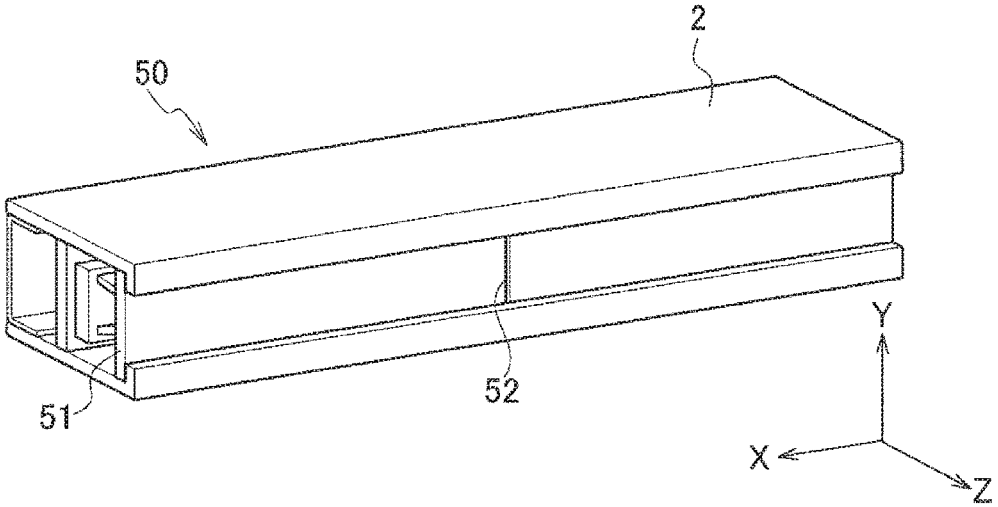
FIG. 5A is a perspective view illustrating a step of movement of a front panel according to another embodiment.
Figure 5B:
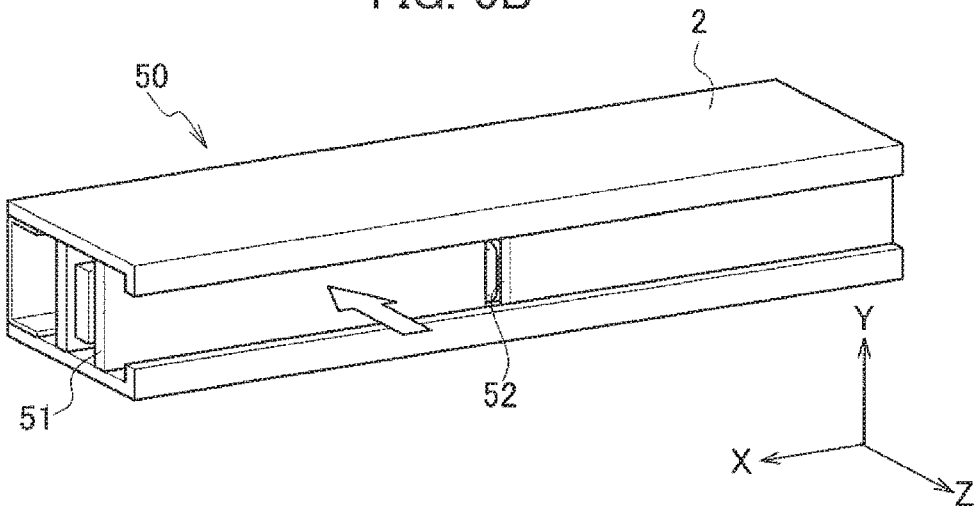
FIG. 5B is a perspective view illustrating a step of movement of the front panel according to the other embodiment.
Figure 5C:
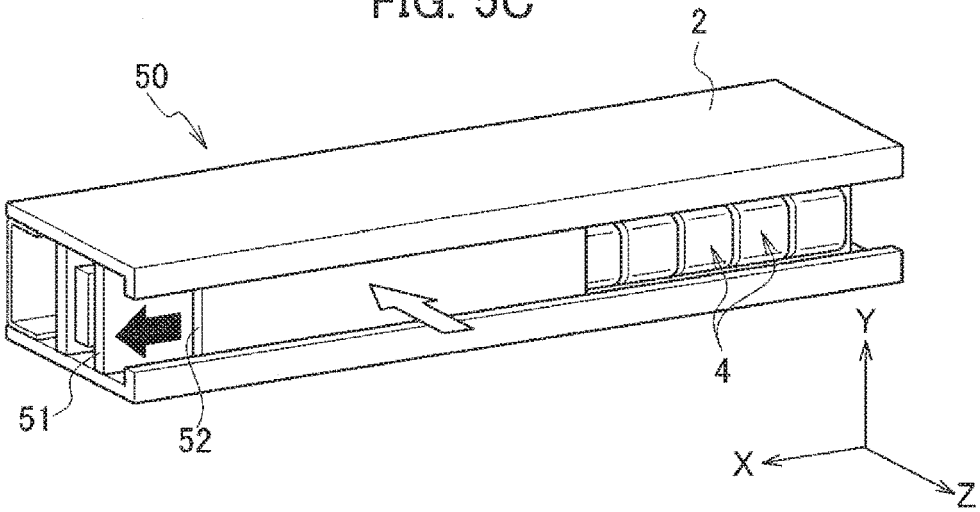
FIG. 5C is a perspective view illustrating a step of movement of the front panel according to the other embodiment.

A configuration of a light fixture according to a second embodiment is described below. FIG. 5A to FIG. 5C are perspective views illustrating the configuration of the light fixture 50 according to the second embodiment and a series of steps of movement of two front panels 51 and 52 included in the light fixture 50. The light fixture 50 differs from the light fixture 1 according to the first embodiment in that the front panel 3 is divided into the two front panels 51 and 52. Although not illustrated in the figures, the panel holding member 10 includes the holding plates 11 and 12 and the pressure mechanisms 13 for each of the front panels 51 and 52 so as to independently move the respective front panels 51 and 52.

The first embodiment needs to install at least two light fixtures 1 aligned next to each other so as to facilitate the operations during maintenance by moving the front panel 3 toward a side surface. In contrast, according to the second embodiment, since at least a second front panel 52 corresponding to the first front panel 51 is aligned on the front surface side in one light fixture 50, the respective front panels 51 and 52 can be moved toward a side surface within the single light fixture 50.

In particular, the operator pushes the first front panel 51, located on the left side in FIG. 5A as viewed from the first space S1, inward as indicated by the white arrow shown in FIG. 5B, for example. In this state, the first front panel 51 is pushed by a distance greater than the thickness T of the respective front panels 51 and 52. The operator then moves the second front panel 52, located on the right side as viewed from the first space S1, toward the adjacent first front panel 51 as indicated by the black arrow shown in FIG. 5C, while keeping the pushed state of the first front panel 51. The second front panel 52 is thus inserted into a space provided in front of the pushed first front panel 51. In addition, the first internal space SI is exposed due to the movement of the second front panel 52 toward the first front panel 51, so that the operator can touch the luminaire body 4 and the like from the first space S1 side. Alternatively, the first front panel 51 may be moved toward the second front panel 52 in the manner reverse to the process described above.

As described above, the present embodiment has the same effects as the first embodiment. Particularly, the present embodiment can facilitate the operations during maintenance such that the front panels 51 and 52 are moved toward the side surface within the single light fixture 50. Accordingly, time light fixture 50 reduces the limitations with respect to the installation position, so as to be applicable to various types of structures.

In the respective embodiments described above, the from panel 3 (51, 52) is in surface contact with the fourth plate 23 and the fifth plate 24 and also in surface contact with the holding plates 11 and 12. The configuration of the surface contact portions, namely, the supported portions of the front panel 3 may be modified as follows.

Figure 6A:
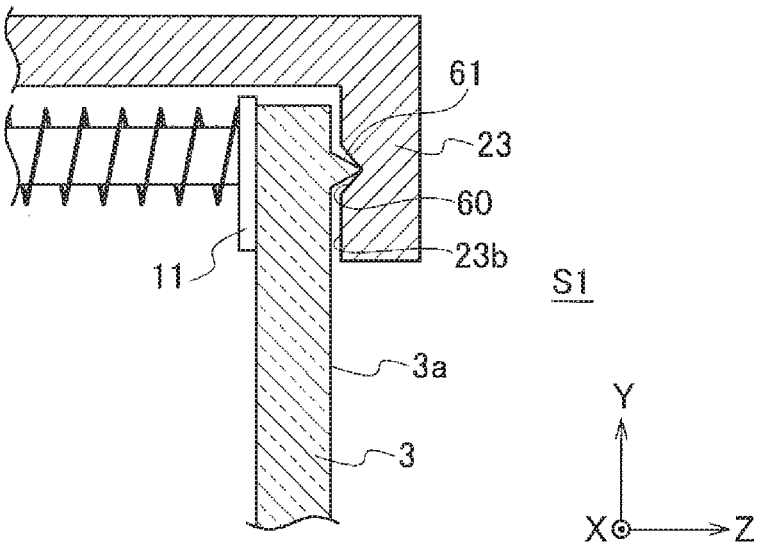
FIG. 6A is an enlarged view showing a modified configuration example of a supported portion of the front panel.
Figure 6B:
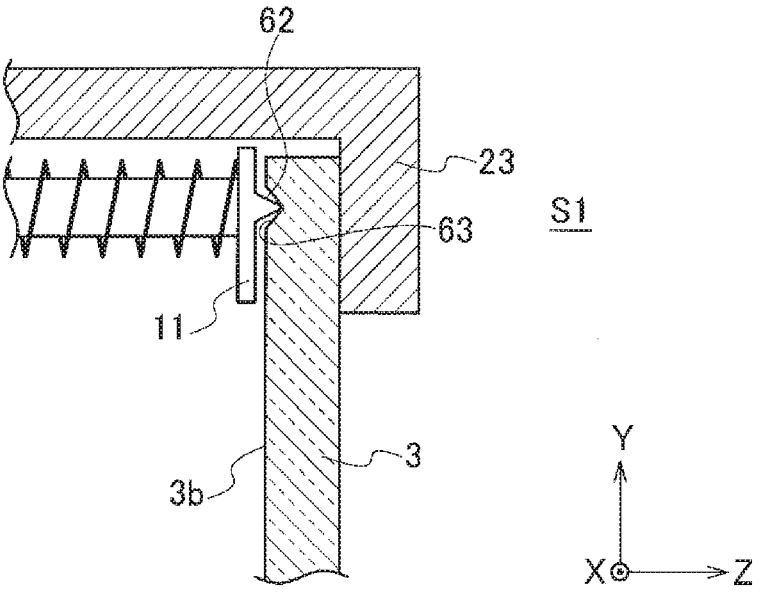
FIG. 6B is an enlarged view showing another modified configuration example of the supported portion of the front panel.

FIG. 6A and FIG. 6B are enlarged cross-sectional views illustrating modified configurations of the supported portions of the front panel 3. FIG. 6A is a view showing a recess 60 provided on the surface 23*b* of the fourth plate 23 and a projection 61 provided on the front panel surface 3*a* of the front panel 3 at a position corresponding to the recess 60. The recess 60 and the projection 61 are engaged with each other and elongated in the direction perpendicular to the retractable direction of the pressure mechanisms 13, which is the X direction in the present embodiment. Although not illustrated in FIG. 6A, the surface 24*b* of the fifth plate 24 is also provided with the recess 60, and the front panel surface 3*a* is provided with another projection 61 at a position corresponding to the recess 60.

According to this configuration, when the operator moves the front panel 3 toward a side surface while slightly pushing the front surface 3 inward from the first space S1 side, for example, the projections 61 provided on the front panel 3 are guided to the recesses 60 provided on the fourth plate 23 and the fifth plate 24. The operator thus can move the front panel 3 in a preferable direction more easily. In addition, since the front panel 3 is normally supported to the frame 2 in the state in which the projections 61 provided on the front panel 3 are engaged with the recesses 60 provided on the fourth plate 23 and the fifth plate 24, the supported state of the front panel 3 is constantly stable without displacement from the supported position even when an external impact is applied to the front panel 3.

FIG. 6B is a view showing a projection 62 provided on the surface of the holding plate 11 and a recess 63 provided on the rear panel surface 3*b* of the front panel 3 at a position corresponding to the projection 62. The projection 62 and the recess 63 are engaged with each other and elongated in the direction perpendicular to the retractable direction of the pressure mechanisms 13, which is the X direction in the present embodiment. Although not illustrated in FIG. 6B, the surface of the holding plate 12 is also provided with the projection 62, and the rear panel surface 3*b* is provided with another recess 63 at a position corresponding to the projection 62.

According to this configuration, when the operator moves the front panel 3 toward a side surface while pushing the front surface 3 inward from the first space S1 side, for example, the recesses 63 provided on the front panel 3 are guided to the projections 62 provided on the holding plates 11 and 12. The operator thus can move the front panel 3 in a preferable direction more easily. In addition, the rear panel surface 3*b* of the front panel 3 is hardly scratched when the front panel 3 is moved because the contact areas between the front panel 3 and the holding plates 11 and 12 are small. Accordingly, dust caused by the slide of the front panel 3 can be reduced, so as to minimize adhesion of dirt to the front panel 3. Further, since the front panel 3 is normally supported to the frame 2 in the state in which the recesses 63 provided on the front panel 3 are engaged with the projections 62 provided on the holding plates 11 and 12, the supported state of the front panel 3 is constantly stable without displacement from the supported position even when an external impact is applied to the front panel 3.

Although the respective embodiments exemplified the case of employing the bolt fastening with the bolts 31 as a means for fixing the light fixture 1 or 50 to the vertical wall 102, the present disclosure is not intended to be limited to this case. For example, although not shown in the figures, the fixing piece 6 on the light fixture 1 side may be provided with a first engagement piece, and the wall surface 102*a* of the vertical wall 102 may be provided with a second engagement piece to be engaged with the first engagement piece. The operator thus can easily fix the light fixture 1 or 50 inserted through the wall opening 101*a* from the first space S1 side to the vertical wall 102 by engaging the first engagement piece with the second engagement piece.

Although the respective embodiments exemplified the case in which the spacers 30 are made of an elastic body, the spacers 30 may be made of metal, instead of the elastic body. For example, metal spacers having different thicknesses may be preliminarily prepared, and the operator may choose and use a spacer having an appropriate thickness at an appropriate position, so as to make fine adjustments to a gap between the wall surface 101*b* and each of the surface 23*a* of the fourth plate 23 and the surface 24*a* of the fifth plate 24.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The entire content of Japanese Patent Application No. 2017-051611 (filed on Mar. 16, 2017) is incorporated herein by reference.

The invention claimed is:

1. A light fixture configured to be embedded in a surface, the light fixture comprising:

a light source;

a front panel located in front of the light source;

a frame in contact with a front panel surface of the front panel;

a pressure mechanism configured to press the front panel surface against the frame; and a fixing piece provided at a position opposite to the front panel on a base surface side opposite to a front surface side on which the front panel surface is exposed, the fixing piece extending outward from the base surface side to fix the frame to an external structure, wherein the pressure mechanism is retractable by a distance greater than a thickness of the front panel when a pushing force is applied to the front panel surface, and the front panel is movable in a direction perpendicular to a retractable direction of the pressure mechanism when the pressure mechanism is retracted.

2. The light fixture according to claim 1, further comprising:

at least a second front panel, corresponding to the front panel and being aligned on the front surface side on which the front panel surface is exposed; and at least a second pressure mechanism, corresponding to the pressure mechanism and being provided to correspond to the second front panel, wherein the pressure mechanism and the second pressure mechanism independently press the respective front panel and the second front panel.

3. The light fixture according to claim 1, wherein the fixing piece is provided with a bolt hole through which a bolt for fastening the fixing piece to the external structure is inserted.

4. The light fixture according to claim 3, further comprising:

a spacer between the fixing piece and the external structure.

5. The light fixture according to claim 1, wherein the frame and the front panel surface, in contact with the frame, are each provided with different ones of a recess and a projection elongated in the direction perpendicular to the retractable direction of the pressure mechanism, the different ones of the recess and the projection being engaged.

6. The light fixture according to claim 1, further comprising:

a holding plate connected to the pressure mechanism and in contact with the front panel, wherein the holding plate and the front panel are each provided with different ones of a recess and a projection elongated in the direction perpendicular to the retractable direction of the pressure mechanism, the different ones of the recess and the projection being engaged.

* * * * *